US008460131B2

(12) United States Patent
Harvey

(10) Patent No.: US 8,460,131 B2
(45) Date of Patent: Jun. 11, 2013

(54) METHOD FOR TRAINING A BASKETBALL PLAYER

(75) Inventor: Clyde Harvey, Kansas City, MO (US)

(73) Assignee: Harvey's H3 and 1, LLC, Kansas City, MO (US)

( * ) Notice: Subject to any disclaimer, the term of this patent is extended or adjusted under 35 U.S.C. 154(b) by 109 days.

(21) Appl. No.: 13/076,129

(22) Filed: Mar. 30, 2011

(65) Prior Publication Data

US 2011/0244993 A1 Oct. 6, 2011

Related U.S. Application Data

(60) Provisional application No. 61/319,910, filed on Apr. 1, 2010.

(51) Int. Cl.
*A63B 69/00* (2006.01)

(52) U.S. Cl.
USPC ..... 473/447; 473/422; 434/248

(58) Field of Classification Search
USPC ... 473/422, 417, 447, 451, 431, 433; 434/248
See application file for complete search history.

(56) References Cited

U.S. PATENT DOCUMENTS

| | | | | | |
|---|---|---|---|---|---|
| 3,820,783 | A | | 6/1974 | Caveness | |
| 4,538,808 | A | | 9/1985 | Holland | |
| 4,579,341 | A | | 4/1986 | Furr | |
| 4,623,148 | A | | 11/1986 | Juhl | |
| 4,717,149 | A | | 1/1988 | Juhl | |
| 4,838,549 | A | * | 6/1989 | Woodall | 473/433 |
| 5,324,026 | A | * | 6/1994 | Conlon et al. | 473/450 |
| 5,364,091 | A | * | 11/1994 | Sebek | 473/433 |
| 5,597,160 | A | * | 1/1997 | Mims | 124/16 |
| 5,800,288 | A | * | 9/1998 | Mims | 473/417 |
| 5,813,926 | A | * | 9/1998 | Vance | 473/448 |
| 6,679,794 | B1 | | 1/2004 | Vitello | |
| 6,712,722 | B1 | | 3/2004 | Mosley | |
| 6,949,034 | B2 | | 9/2005 | Vitello | |
| 2007/0202969 | A1 | * | 8/2007 | Girard | 473/447 |
| 2008/0280704 | A1 | * | 11/2008 | Noll | 473/447 |
| 2010/0267496 | A1 | * | 10/2010 | Johnson | 473/447 |
| 2011/0207561 | A1 | * | 8/2011 | Adams | 473/447 |
| 2011/0244993 | A1 | * | 10/2011 | Harvey | 473/447 |

* cited by examiner

*Primary Examiner* — Mitra Aryanpour
(74) *Attorney, Agent, or Firm* — David E Herron, II

(57) ABSTRACT

The disclosure describes a method and apparatus for training a basketball player proper movement of a player's feet. The method includes positioning a stand at a generally central location in front of a player's body, with a first foot slightly ahead of the second. The ball is positioned on the stand, then the player grabs the ball from the stand, steps over the stand, squares up to the basket and shoots the ball.

6 Claims, 11 Drawing Sheets

METHOD FOR TRAINING A BASKETBALL PLAYER

This application claims domestic priority based upon provisional patent application serial No. 61/319,910 filed on Apr. 1, 2010.

BACKGROUND OF THE INVENTION

The game of basketball has long endured as an American tradition, and is enjoyed by men and women of all ages and myriad skill levels. As with any motor skill, teachers and coaches have developed drills and apparatus that help teaching players to shoot a basketball properly. The invention herein is best used to help shooters develop proper habits, form, footwork and posture for shooting a basketball.

SUMMARY OF THE INVENTION

The invention is a method and apparatus best used for training a basketball player to use the proper form and footwork for shooting a basketball.

The Inventive Method

The inventive method includes the steps of a stand including a ground-engaging base. The stand will also have an elongate member extending upwardly from the base such that its primary engages the base, and its terminal end engages a receptacle adapted to receive a basketball.

The method requires one to place a basketball on the receptacle, then have the player assume a ready stance. The ready stance requires a player to put a first foot forward of the stand and adjacent the first side of the base of the stand, then put a second foot slightly behind the stand and adjacent the second side of the base of the stand. The ready stance also requires that the player's hands be positioned at a location spaced from the ball but on opposite sides of it.

The method also requires the player to move from the ready stance to a shooting position by grasping the basketball and removing it from the receptacle. The method also requires the player to position his second foot slightly in front of the base of the stand and step over the elongate member while moving the basketball to the shooting position.

Preferably, the method will have the player setting both his feet in a shooter's position, approximately shoulder-with apart in a configuration commonly referred to as squared up to the basket. Once the ball is in a launch position and the player's feet are squared up, then the player shoots the ball.

In this preferred embodiment, the player chooses one of his feet to remain stationary and serve as a pivot foot, while the player moves his other leg to step over the elongate member and square his feet to the basket. Generally, a right-handed shooter will select his left foot as a pivot foot and step through using his right foot; conversely, a lefty will keep his right foot planted and step through with his left hand.

The inventive method may optionally include the step of requiring the player to pause briefly when the ball reaches the shooting position. Of course, the player then shoots the basketball after this brief pause. Most believe that this brief pause will not only encourage and enhance muscle memory, the brief pause will also require the player to focus on proper position, rhythm and form.

In that regard, the method may incorporate several pauses. For example, the method may optionally include the step of giving a first signal that alerts the player to assume a ready stance. A ready stance, of course, requires a player to position a first foot adjacent a first side of the base, and his other foot adjacent the other side of the base. The ready position also may require the player to position her hands near opposite ends of the ball.

In this method, a second signal will alert the player to grasp the ball and move it to a shooting position, and meanwhile step her second foot into a squared up configuration by stepping over the stand.

The elongate member may have an adjustable length, for example a pair (or more) of telescoping tubes that cooperate to form an elongate member. It is found that the terminal end of the member should be adjusted such that the receptacle is positioned approximately knee high to the player.

The Inventive Apparatus

The invention is also unique apparatus for training a basketball player proper to execute proper shooting form. The apparatus will have a ground-engaging base and an elongate member extending upwardly from the base. A first end of the elongate member engages the base, and it terminates in a terminal end with a receptacle adapted to receive a basketball positioned adjacent the terminal end.

The best mode of using the apparatus requires a player to position a first foot slightly forward of the base and adjacent a first side of the base of the stand, and position a second foot slightly behind the stand and adjacent the second side of the base of the stand. The a player removes a basketball from the receptacle with his hands, then moves the ball to a shooting position, and meanwhile steps over the elongate member and squares his feet to the basket then shoots the basketball.

The elongate member may comprise an open-ended tube; in this embodiment, the receptacle includes an open end of the tube. In another embodiment, the elongate member includes a rod having a receptacle positioned adjacent its second end. The rod, of course, may have an adjustable length. Preferably, the elongate member will position the receptacle and basketball at a position that is slightly above the height of the player's knees.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
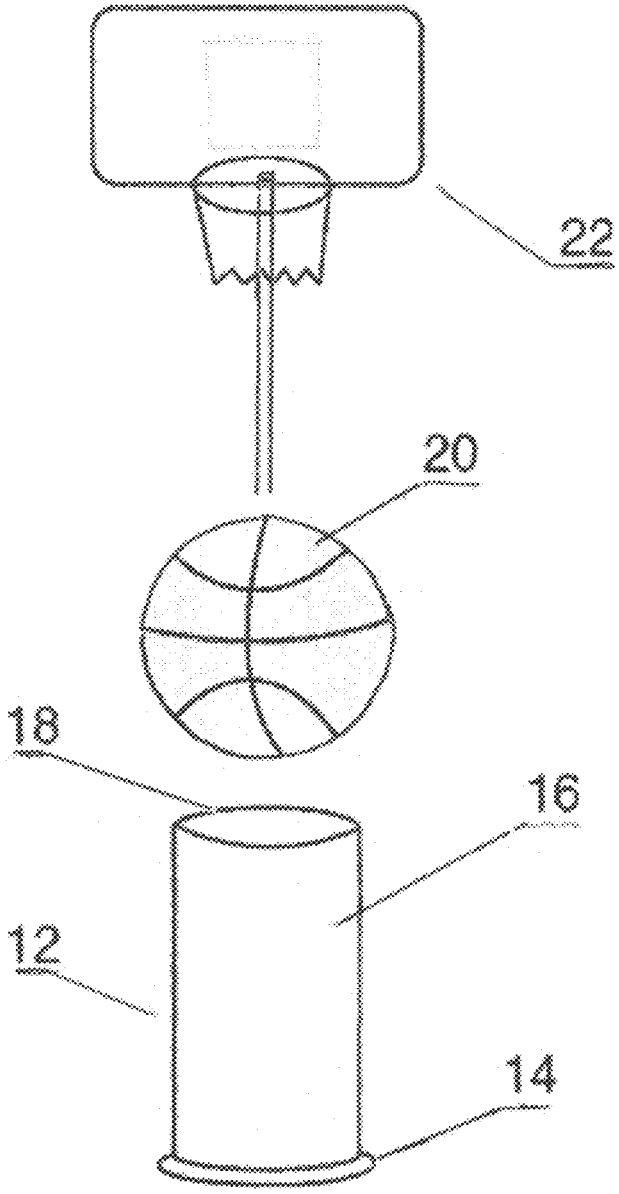
FIG. 1 is a perspective view showing several aspects of the invention

FIG. 1 is an exploded and perspective view that details the components of the inventive apparatus 10 and method. The invention includes a stand 12 having a ground engaging base 14 and an elongate member 16 extending upwardly from the base 14. The elongate member 16 terminates in a receptacle 18 that is adapted to receive a basketball 20. The invention is best used to teach players how to properly shoot the basketball 20 toward a standard basketball goal 22.

As shown in FIG. 1, a preferred embodiment of the elongate member 16 is to incorporate an open-ended tube that is approximately knee-high to a player. In this embodiment of the member 16, the receptacle 18 comprises the open end of the tube. Of course, this embodiment requires the tube to have a diameter sufficient to support the basketball when placed on the receptacle 18. Of course, the elongate member 16 may also include a rod having a receptacle positioned adjacent its end.

Figure 2:
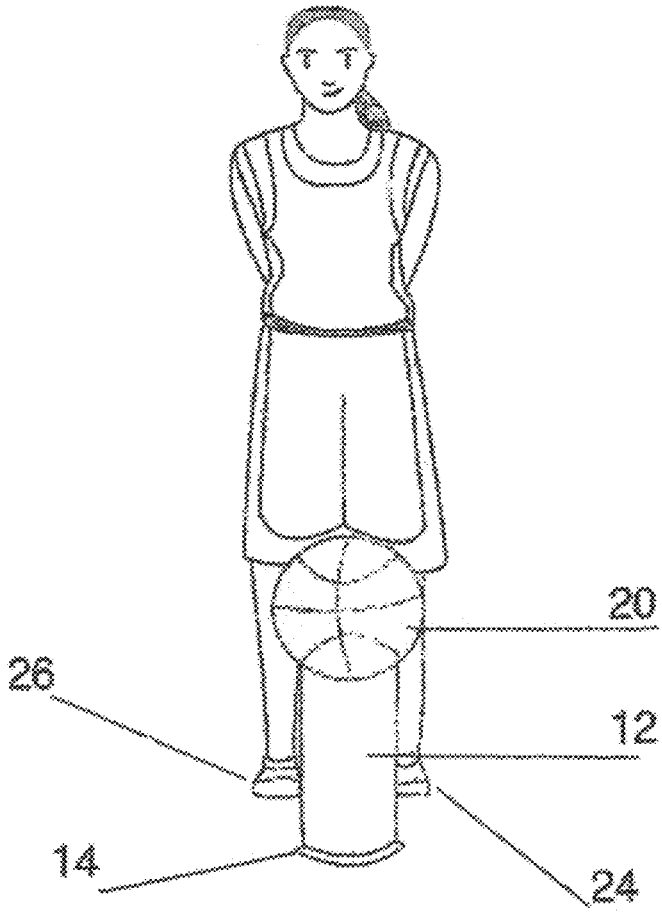
FIG. 2 is a first perspective view showing a player approaching a basketball in a ready stance, according to the principles of the invention.

FIG. 2 shows a perspective view of a player in an at-rest position standing behind the stand 12. As shown, the ball 20 rests in the receptacle 18 (FIG. 1) of the stand 12, which is about knee-high to the player. The player's feet 24, 26 are about shoulder width apart and behind the base 14 of the stand 12. In the at rest position shown in FIG. 2, the player's feet are slightly behind the base 14 of the stand 12, enabling the player to take a small step forward into the ready stance shown in FIG. 3.

Figure 3:
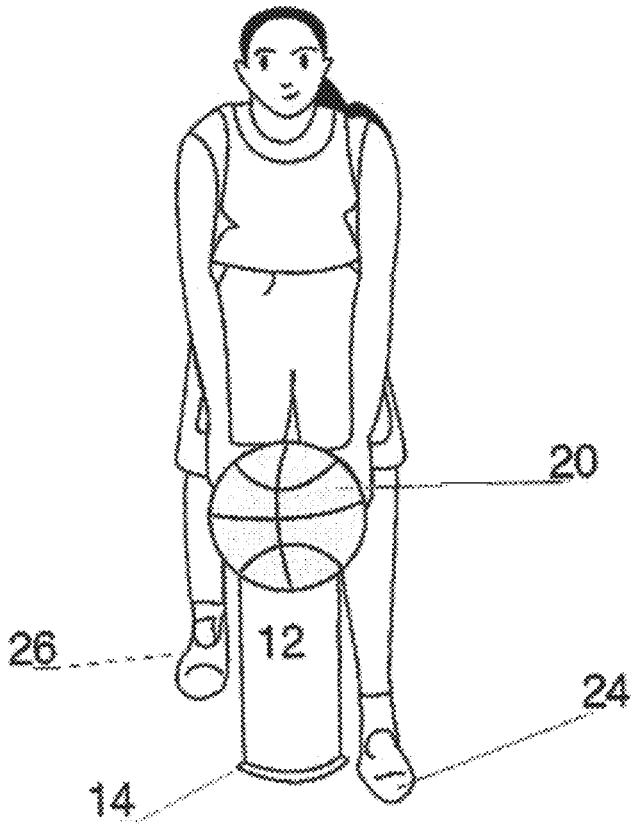
FIG. 3 is a second perspective view showing a player executing the invention, shown in a shooting stance.

FIG. 3 shows a perspective view of a player assuming a ready stance, according to the principles of the invention. In this ready stance, the ball 20 is positioned on the stand while the player stands with his feet 24, 26 about shoulder width apart, and the base 14 of the stand 12 generally centered before the player.

As shown in FIG. 3, the player positions a first foot 24 slightly ahead of the base 14 and off to a first side of the stand 12, and his second foot 26 slightly behind the base 14 and off to the second side of the stand 12. In the ready position as shown, the player positions his hands on opposite sides of the ball 20, ready to remove from the stand 12 and proceed to the shooting position.

Figure 4:
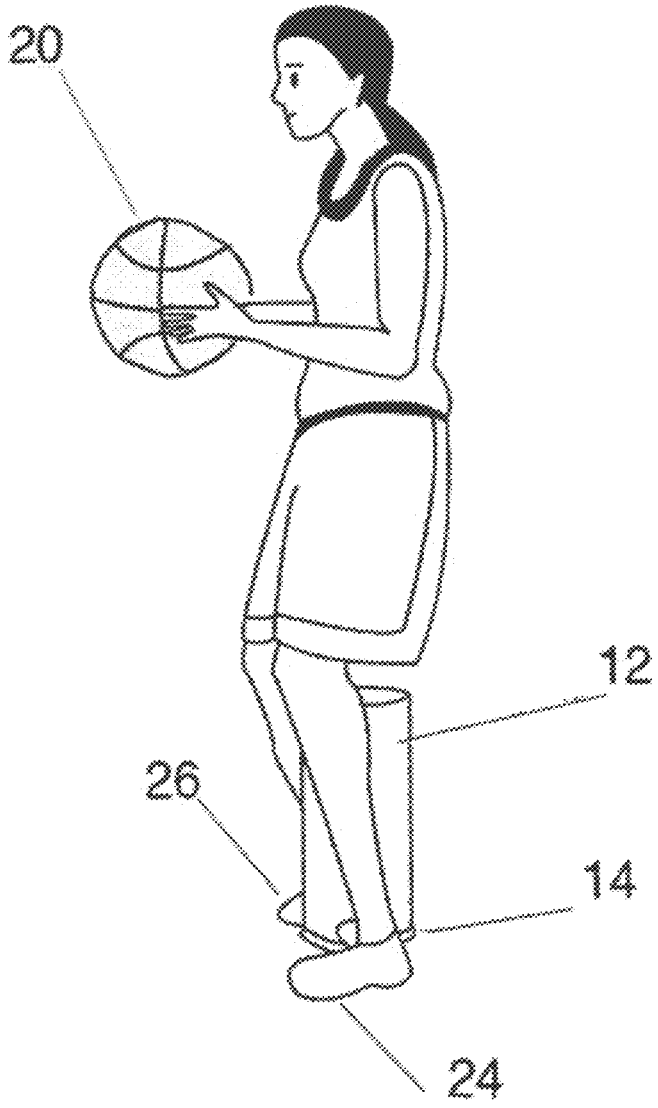
FIG. 4 is perspective view showing a player in a poised position.

FIG. 4 shows the player in a poised position with the ball 20 removed from the stand 12 and elevated to approximately the player's chest. In this poised position, the player moves her second foot 26 square with her first foot (i.e., pivot foot) so that the base 14 of the stand 12 is between her feet 24, 26. Once the player reaches the poised position, the player than proceeds to a shooting position.

Figure 5:
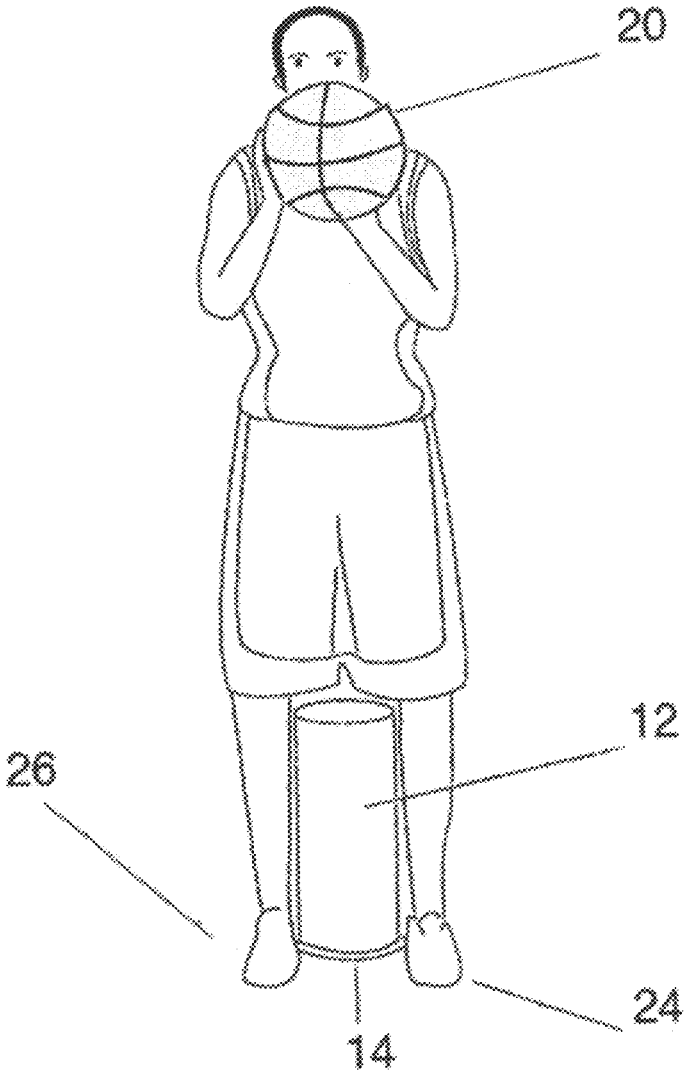
FIG. 5 is a perspective view showing a player in a shooting position.

FIG. 5 shows the player in a shooting position. As shown, the player's first foot 24 remains as a pivot foot; this first foot 24 should remain in substantially the same position in FIG. 3 as it was in FIG. 2. However, the player's second foot 26 should move from its previous location to a configuration such that the player's feet are about shoulder with apart and positioned such that his first foot 24 and second foot 26 are both slightly ahead of the base 14. FIG. 5 shows the progression in that the player moves the ball 20 from the stand 12, to a poised position (FIG. 4) to an elevated, shooting position, as shown. Preferably, the player keeps his first foot 24 planted, steps over the stand 12 by moving his second foot 26 into a squared-up position, and meanwhile moves the ball to its launch position all with a fluid and controlled rhythmic movement.

Figure 6:
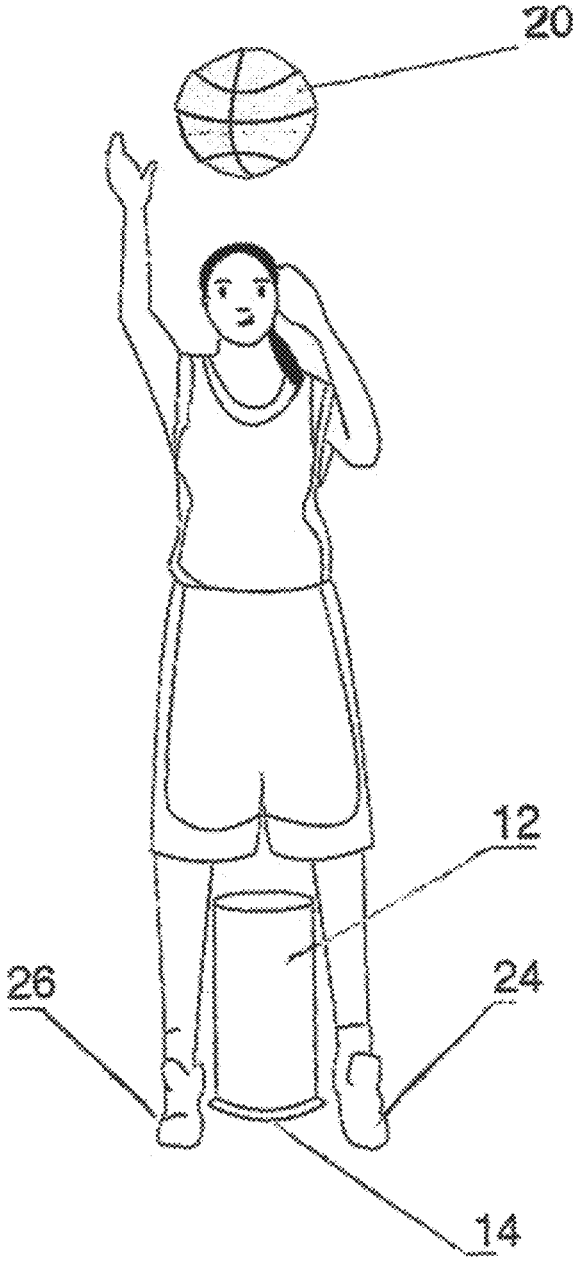
FIG. 6 is a perspective view detailing a player's follow through after shooting.

FIG. 6 shows a player in a follow-through position after releasing the ball 20. Note that the player's feet 24, 26 remain on opposite sides of the base 14 of the stand 12. Generally, the stand 12 should remain positioned between the player's feet 24, 26 even after the ball 20 is in flight.

In a preferred embodiment of the inventive method, a coach or trainer may sound several signals. For example, at the first signal, a player shall move from an at-rest position (FIG. 2) and assume the ready stance as shown in FIG. 3. At a second signal, the player may grasp the ball 20, step over the stand 12, move his second foot 26 to be squared up with his first foot, and move the ball to a poised position as shown in FIG. 4. At the sound of a third signal, the player may proceed to the shooting position as shown in FIG. 5. At a final signal, the player will release the ball 20 toward a goal 22 (see FIG. 1), as in FIG. 6.

Figure 7:
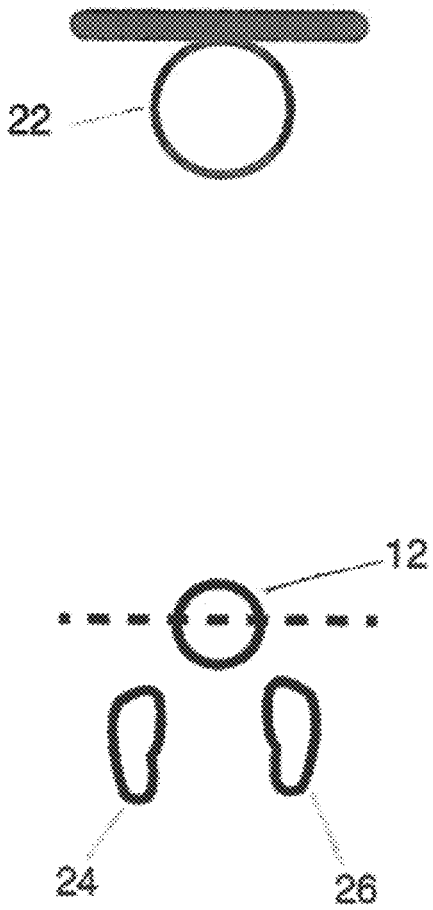
FIG. 7 shows the relative positioning of the feet, base and goal when a player is in an at-rest position.
Figure 8:
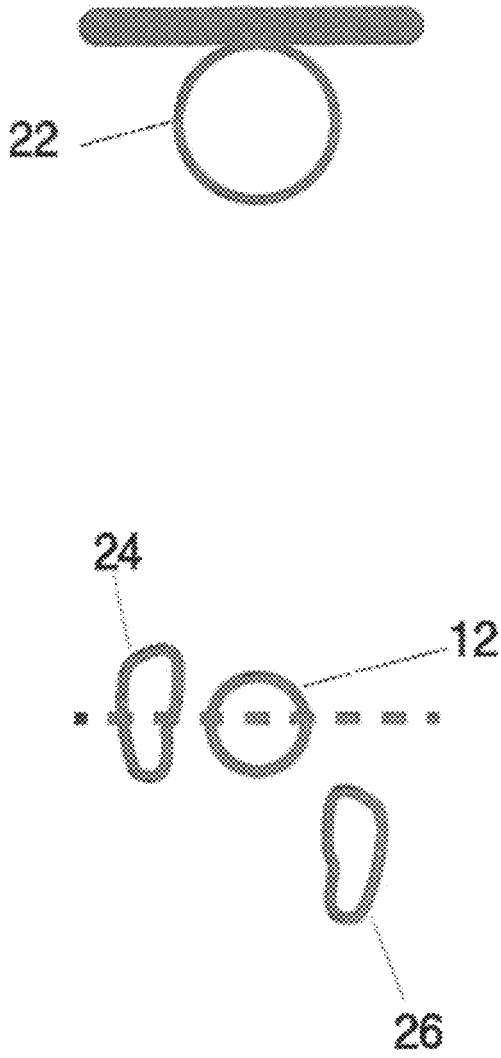
FIG. 8 shows the relative positioning of the feet, base, and goal when a player assumes a ready stance.
Figure 9:
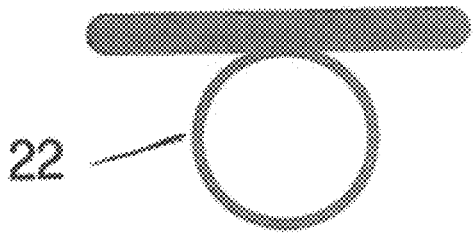
FIG. 9 shows the relative positioning of the feet, base, and goal when a player assumes a shooting stance.
Figure 9:
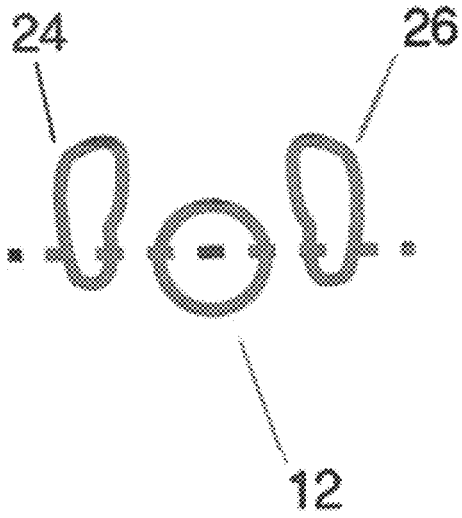

FIGS. 7, 8 and 9 show comparative views of the preferred positioning of a player's feet as the player proceeds from an at-rest position (FIG. 2) to a shooting position (FIG. 5). Each figure has a dotted line representing an imaginary line that is squared up with the goal 22.

FIG. 7 shows the preferred feet position when a player is at rest with both feet 24, 26 behind the stand 12. In this position, the base 14 is positioned at a position in front of and forming a triangle with the player's feet. As in FIG. 8, the player moves her first foot 24 forward until it is slightly ahead of the center line L; her second foot 26 stays put. In this position, the base 14 is positioned at a position in front of the player's body but between the player's feet. In contrast, FIG. 9 shows the preferred positioning of a player's feet when in a shooting position. Note that FIG. 9 requires the player to move her second foot 26 from a position slightly behind center line L to a position substantially squared up with the player's first foot 24. In the position set forth in FIG. 9, note that the first foot 24 and second foot 24 are now substantially parallel with center line L, and generally squared to the goal 22, which is preferred for proper shooting form.

Figure 10:
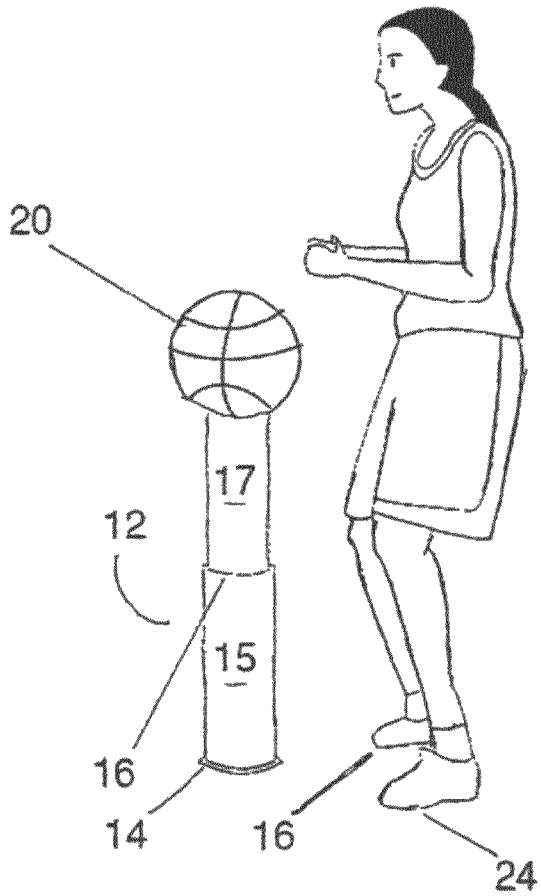
FIG. 10 shows a perspective view of a second preferred embodiment of the invention, shown with the player in a poised position.

FIG. 10 shows a perspective view of a second preferred embodiment of the invention. In this embodiment, the stand 12 comprises an elongate member 16 that has a lower tube 15 that extends from the base 14 to an open top. The elongate member 16 also includes an upper tube 17 that fits within the lower tube 15. In this preferred embodiment, the length of the elongate member 16 is selectively adjustable so that the ball 20 is approximately waist-height on a player positioned behind the stand 12.

Figure 11:
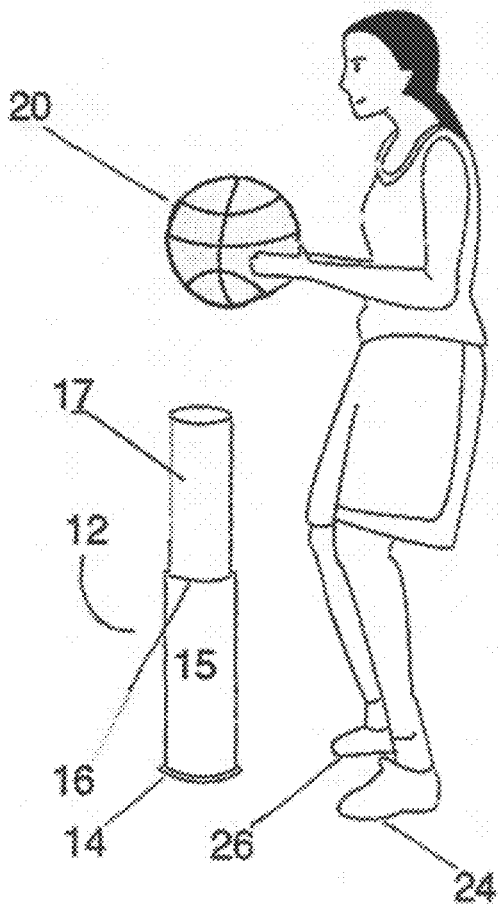
FIG. 11 shows a perspective view of a second preferred embodiment of the invention, shown with the player in a shooting position.

As shown in FIG. 11, the invention then allows the player to remove the ball 20 from the stand 12, then elevate the ball 20 to a shooting position, preferably without moving the player's feet 24, 26. Other embodiments and variations of the method shown in FIGS. 9 and 10 are also within the scope of the invention. For example, the player may position the stand 12 to the player's side, requiring the player to keep one foot planted, pivot to remove the ball 20 from the stand 12, then pivot again to square up to the basket and assume a shooting position. In this way, the invention allows the player to mimic the footwork, body position, and hand movements required in receiving a pass from a teammate, planting her pivot foot, squaring to the basket, and launching a shot.

Having described in detail the invention, it is to be understood that this description is for illustrative purposes only. The scope of the invention shall be limited only by the appended claims which precisely set forth the invention.

I claim:

1. A method of training a basketball player proper movement of a player's feet, the method including the steps of:

providing a stand including a ground-engaging base, and an elongate member extending upwardly from the base, the elongate member having a first end engaging the base and a second end engaging a receptacle adapted to receive a basketball; placing a basketball on the receptacle;

said player assuming a ready stance by:

positioning a first foot at a position forward of the stand and adjacent a first side of the base of the stand;

positioning a second foot at a position slightly behind the stand and adjacent the second side of the base of the stand;

the player placing both hands adjacent opposite sides of the basketball;

the player assuming a shooting position by:

grasping the basketball and removing it from the receptacle;

moving the basketball to a launch position; and moving the second foot to a position forward of the stand;

wherein, the player steps over the stand and squares both feet with respect to a basketball goal while moving the basketball to the launch position and shooting the basketball towards said basketball goal.

2. The method as in claim 1, further including the step of the player maintaining his or her first foot as a pivot foot.

3. The method as in claim 1, further including the step of said player pausing at the launch position, then shooting the basketball towards said basketball goal.

4. The method as in claim 1, wherein the elongate member has an adjustable length.

5. The method as in claim 1, further including the steps of a coach or trainer giving a first signal when the player is to begin the step of assuming the ready stance; and, the coach or trainer giving a second signal when the player is to begin the step of assuming the shooting position; and, the coach or trainer giving a third signal to alert the player to shoot the basketball.

6. The method as in claim 1, wherein the elongate member comprises a tube; and wherein, the receptacle is an open end of the tube.

* * * * *